US005087137A

United States Patent [19]

Burnard et al.

[11] Patent Number: 5,087,137

[45] Date of Patent: Feb. 11, 1992

[54] RIBBON ASSEMBLY INCLUDING INDICIA TO IDENTIFY OPERATING PARAMETERS AND RIBBON DEPLETION

[75] Inventors: Jonathan J. Burnard, Brookline; Brendan Fee, Litchfield, both of N.H.

[73] Assignee: Datamax Corporation, Orlando, Fla.

[21] Appl. No.: 221,319

[22] Filed: Jul. 19, 1988

[51] Int. Cl.[5] ..... B41J 33/32

[52] U.S. Cl. ..... 400/249

[58] Field of Search ..... 400/103, 120, 144.3, 400/208, 225, 232, 241, 249

[56] References Cited

U.S. PATENT DOCUMENTS

| | | | |
|---|---|---|---|
| 4,074,798 | 2/1978 | Berger | 400/144.3 |
| 4,091,913 | 5/1978 | Ku et al. | 400/225 X |
| 4,111,378 | 9/1978 | Barwick | 400/249 X |
| 4,251,276 | 2/1981 | Ferree, Jr. et al. | 400/241 X |
| 4,375,339 | 3/1983 | Dyer et al. | 400/249 |
| 4,573,059 | 2/1986 | Shinma | 346/76 PH |
| 4,666,320 | 5/1987 | Kobayashi et al. | 400/241.1 |
| 4,747,716 | 5/1988 | Van der Eikel | 400/249 |
| 4,790,677 | 12/1988 | Kress | 400/249 |
| 4,797,016 | 1/1989 | Lahr | 400/225 X |
| 4,797,018 | 1/1989 | Hofmann et al. | 400/249 |

FOREIGN PATENT DOCUMENTS

| | | | |
|---|---|---|---|
| 0085975 | 5/1985 | Japan | 400/249 |
| 0168688 | 9/1985 | Japan | 400/249 |
| 2184708 | 7/1987 | United Kingdom . | |

OTHER PUBLICATIONS

Patent Abstracts of Japan, unexamined applications, Field M, vol. II, No. 64, Feb. 26, 1987, p. 148 M 565, Kokai-no. 61-222 772, Fuji Xerox.

*Primary Examiner*—Eugene H. Eickholt

[57] ABSTRACT

A ribbon assembly having a ribbon supply spool and a ribbon take-up spool. Attached to either the ribbon supply spool or the ribbon take-up spool is a bar code. The bar code is machine readable and is encoded with data relevant to the operation of printing means suitable to employ the ribbon assembly. The printing means comprises reading means for reading the bar code present on the ribbon assembly. Based on the information encoded on the bar code and read by the reading means, the operating parameters of the printing means are adjusted for the specific ribbon assembly employed.

8 Claims, 3 Drawing Sheets

RIBBON ASSEMBLY INCLUDING INDICIA TO IDENTIFY OPERATING PARAMETERS AND RIBBON DEPLETION

BACKGROUND OF THE INVENTION

The present invention concerns a ribbon assembly. Specifically, it concerns a ribbon assembly for printers and other devices which utilize a printing ribbon.

Ribbon assemblies for various printing devices typically comprise a ribbon supply reel, a ribbon take-up reel, and a length of printing ribbon. The ribbon supply reel is usually disposed on one side of a printhead with the ribbon take-up reel being disposed on the opposite side of the printhead. In operation, the ribbon supply reel rotates about a center axis in a direction which allows ribbon to be removed from the ribbon supply reel. Similarly, the ribbon take-up reel rotates about a center axis in a direction which allows the ribbon take-up reel to collect ribbon dispensed by the ribbon supply reel. As the ribbon moves from the ribbon supply reel to the ribbon take-up reel, it passes in front of a printhead which causes a printing medium, such as ink, provided on the ribbon to transfer to a printing surface.

If the printing ribbon is designed for multiple uses, it is often necesary to reverse the direction of rotation of the ribbon supply reel and ribbon take-up reel in order to allow the ribbon to be moved in a reverse direction. This allows the printing ribbon to pass in front of the printhead more than once. Typically, this has been achieved by manually reversing the direction of rotation of the ribbon supply reel and ribbon take-up reel.

Many printing ribbons are thermally operated wherein the printing medium is transferred to the printing surface upon application of thermal energy. A thermal printhead is adapted to supply the thermal energy to the thermal printing ribbon in an appropriate manner. In thermal printing, to assure consistent printing performance, it is desirable to control various operating parameters including the temperature of the printhead, the speed of printing, the speed with which the print ribbon passes in front of the printhead, and the like.

With known ribbon assemblies and printheads, these operating parameters have typically been set manually and adjusted as printing conditions change. For instance, if a first thermal printing ribbon is replaced with a second thermal printing ribbon, it may be necessary to manually adjust the thermal energy output of the printhead in order to assure consistent printing.

SUMMARY OF THE INVENTION

It is an object of the present invention to provide a method for automatically controlling various operating parameters of a printer. According to an embodiment of the present invention, this is accomplished by providing a printer which is adapted to alter its operating parameters based on data provided to said printer. Data is provided to the printer from a reading means which reading means reads coded indicia such as a bar code carried by a printer ribbon spool of a ribbon assembly used with the printer.

It is a further object of the present invention to provide a printing assembly which is capable of automatically altering operating parameters of the printing assembly based on changing printing conditions. According to an embodiment of the present invention, this is accomplished by a printing assembly comprising a printer which is adapted to automatically alter operating parameters in response to data provided thereto.

The assembly further comprises a ribbon assembly adapted for use with the printer and comprising coded indicia such as a bar code encoded with data relevant to the operation of the printer. Finally, the assembly comprises a means for reading the coded indicia (bar code) and providing data encoded therein to the printer. In operation, the reading means reads the coded indicia (bar code) and provides data concerning operating parameters of the printer to the printer which automatically adjusts to said operating parameters.

Finally, an embodiment of the present invention concerns a ribbon assembly which comprises a bar code containing encoded data concerning the conditions suitable for printing with the ribbon assembly. Such conditions include ribbon speed, printing temperature, and the like.

BRIEF DESCRIPTION OF THE DRAWINGS

In the drawings, wherein like numerals designate corresponding parts in the several figures.

DETAILED DESCRIPTION OF THE INVENTION

The following description is the best presently contemplated mode of carrying out the invention. This description is made for the purposes of illustrating the general principles of the invention, and is not to be taken in a limiting sense. The scope of the invention is best determined by the appended claims.

Figure 1:
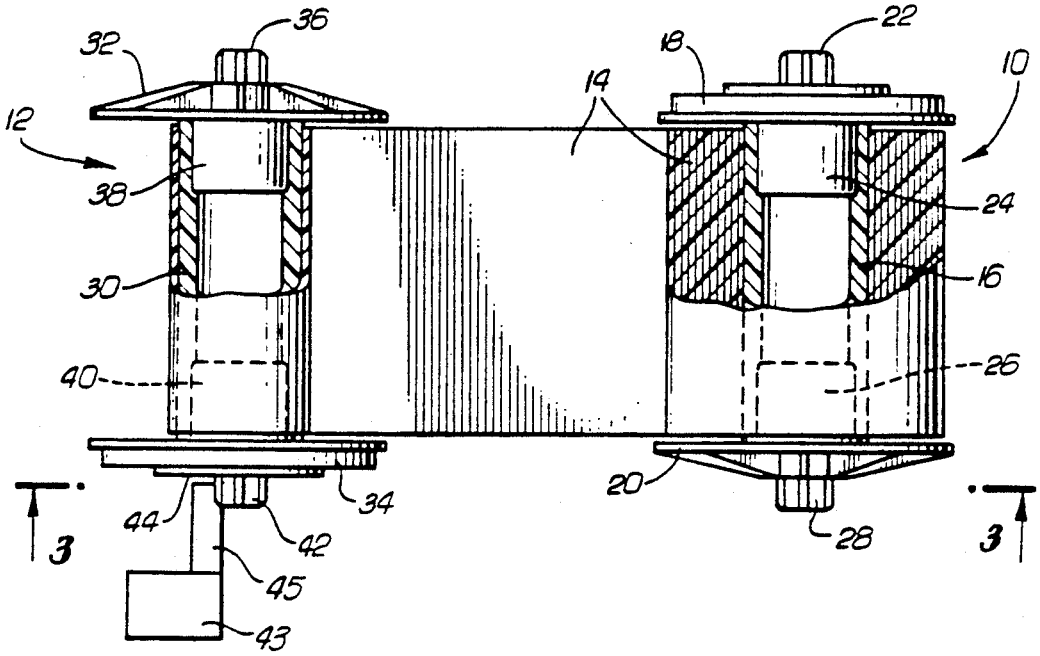
FIG. 1 is a lateral view of a cross-section of the ribbon assembly according to an embodiment of the present invention.

FIG. 1 represents a lateral cross-sectional view of the ribbon assembly according to an embodiment of the present invention taken along a central vertical axis. FIG. 1 illustrates a ribbon supply spool 10 for holding and supplying ribbon, a ribbon take-up spool 12 for receiving and holding ribbon, and a printing ribbon 14.

The ribbon supply spool 10 comprises a supply core 16 for holding a first supply flange 18, and a second supply flange 20 in a spaced, generally parallel relationship. In the embodiment of the present invention depicted in FIG. 1, the supply core 16 is depicted as a hollow cylinder. Those skilled in the art will realize that the supply core 16 may vary in shape and diameter. In the illustrated embodiment, the supply core 16 maintains the first supply flange 18 and the second supply flange 20 in a spaced relationship, and the supply core 16 is capable of having the ribbon 14 wound therearound.

The supply core 16 may be manufactured from any material possessing sufficient structural integrity to allow the supply core 16 to perform the functions heretofore described. Exemplary of such materials are Kraft paper, Kraft paperboard, metal, organic polymeric material, and the like. Exemplary of suitable organic polymeric material from which the supply core 16 may be constructed are styrene, nylon, ABS, and the like.

Attached to one end of the supply core 16 is the first supply flange 18 which provides a boundary for the printing ribbon 14 when wound about the supply core 16. Integrally attached to the first supply flange 18 is a first supply flange gear 22 designed to cooperate with a drive mechanism (not shown) suitable for causing the rotation of the ribbon supply spool 10. Any method suitable for firmly attaching the first supply flange 18 to the supply core 16 is suitable for use in the illustrated embodiment. In the embodiment of the present invention depicted in FIG. 1, the first supply flange 18 is integrally attached to a first supply flange plug 24 which in turn fits firmly within the supply core 16. Alternatively, the first supply flange 18 could be integrally formed with the supply core 16.

The second supply flange 20 which provides a boundary for the printing ribbon 14 when wound about the supply core 16, is firmly attached to the supply core 16 in the same manner as described with respect to the first supply flange 18; that is, by second supply flange plug 26. Similarly, a second supply flange gear 28 is integrally attached to the second supply flange 20 and is adapted to cooperate with a drive mechanism.

First and second supply flanges (18 and 20, respectively), plugs (24 and 26, respectively) and gears (22 and 28, respectively) are suitably made from any material possessing the structural integrity necessary to allow the various elements to perform their functions. Exemplary of such materials are metal, organic polymeric material, and the like. Exemplary of suitable organic polymeric material are styrene, ABS, urethanes, acrylates, nylons, and the like.

The ribbon take-up spool 12 is adapted to rotate about a central axis and receive, in a winding relationship, the ribbon 14 which is being supplied from the ribbon supply spool 10. The parts of the ribbon take-up spool 12 are similar in design and function to the corresponding parts of the ribbon supply spool 10.

The ribbon take-up spool 12 comprises a take-up core 30 for holding a first take-up flange 32 and a second take-up flange 34 in a spaced generally parallel relationship. Attached to one end of the take-up core 30 is the first take-up flange 32 which provides a boundary for the printing ribbon 14 when wound about the take-up core 30. Integrally attached to the first take-up flange 32 is a first take-up flange gear 36 designed to cooperate with a drive mechanism (not shown) suitable for causing the rotation of the ribbon take-up spool 12. The first take-up flange 32 is integrally attached to a first take-up flange plug 38, which in turn fits firmly within the take-up core 30.

The second take-up flange 34, which provides a boundary for the printing ribbon 14 when wound about the take-up core 30, is firmly attached to the take-up core 30 in the same manner as described with respect to the first take-up flange 32; that is, by a second take-up flange plug 40. A second take-up flange gear 42 is integrally attached to the second take-up flange 34 and is designed to cooperate with a drive mechanism to cause the rotation of the ribbon take-up spool 12.

Figure 6:
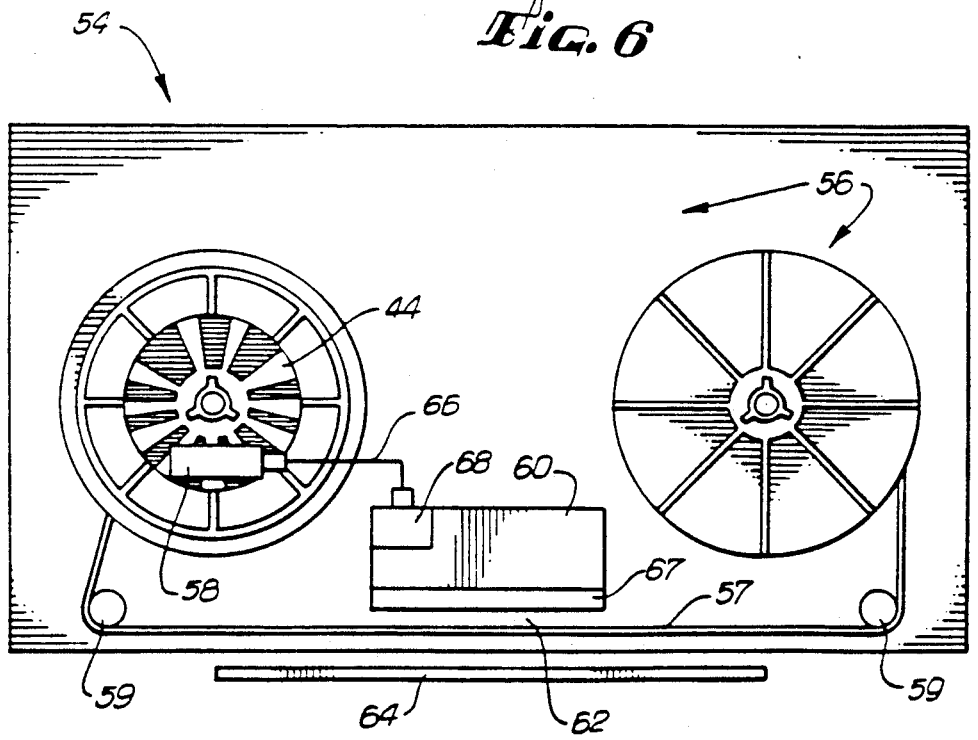
FIG. 6 is a lateral view of the printing assembly of an embodiment of the present invention.
Figure 7:
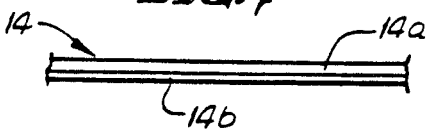
FIG. 7 is a side view of a portion of a ribbon.

The ribbon 14 comprises a substrate and a printing medium (e.g., **14*a* and 14*b* in FIG. 7). The ribbon 14 is capable of cooperating with a printing device (e.g., printing means 60 a FIG. 6) to cause an image to be printed on a printing surface (e.g., printing surface 64 in FIG. 6**). Suitable printing ribbons are known in the prior art. Exemplary of such printing ribbons are cloth or cloth-like ribbons impregnated with ink; an organic resinous substrate having adhered to one surface thereof a carbonaceous, pressure-sensitive compound; an organic resinous substrate having adhered to one surface thereof, a temperature sensitive printing medium; and the like.

In one preferred embodiment of the present invention wherein the printing device is a thermal printer, the ribbon 14 (a portion of which is shown in FIG. 7) comprises an organic polymeric substrate **14*a* having adhered to one surface thereof, a temperature-sensitive ink 14*b*. In use, the thermal printhead (e.g., reference character 67 in FIG. 6) applies thermal energy to selected portions of the ribbon 14. The application of such thermal energy causes the temperature-sensitive ink 14*b* present on one surface of the ribbon substrate 14*a* to melt and thereby be transferred to a printing surface. Exemplary of suitable organic resinous polymeric substrates are the polyesters. The substrate 14*a* generally has a thickness between 1.5 and 10 microns, preferably between about 2.5 and 5 microns, most preferably about 3.5 microns. The temperature-sensitive ink 14*b* has a melting point below the melting point of the substrate material 14*a*. Generally, the temperature sensitive ink 14*b*** has a melting point within the range of from about 30° C. to about 90° C., beneficially from about 50° C. to about 80° C., preferably about 60° C. to about 70° C.

The ribbon assembly of the present invention has affixed to a printer spool, either the ribbon supply spool 10 or the ribbon take-up spool 12, at least one machine readable code such as the bar code 44. Bar codes are known to those skilled in the art. The term "bar code" refers to a code consisting of a group of printed and variously patterned bars and spaces and sometimes numerals. The bar codes are designed to be scanned or read by scanning or reading means such as infra-red scanners. It is possible that other suitable machine readable coded indicia may be used as well.

Figure 2:
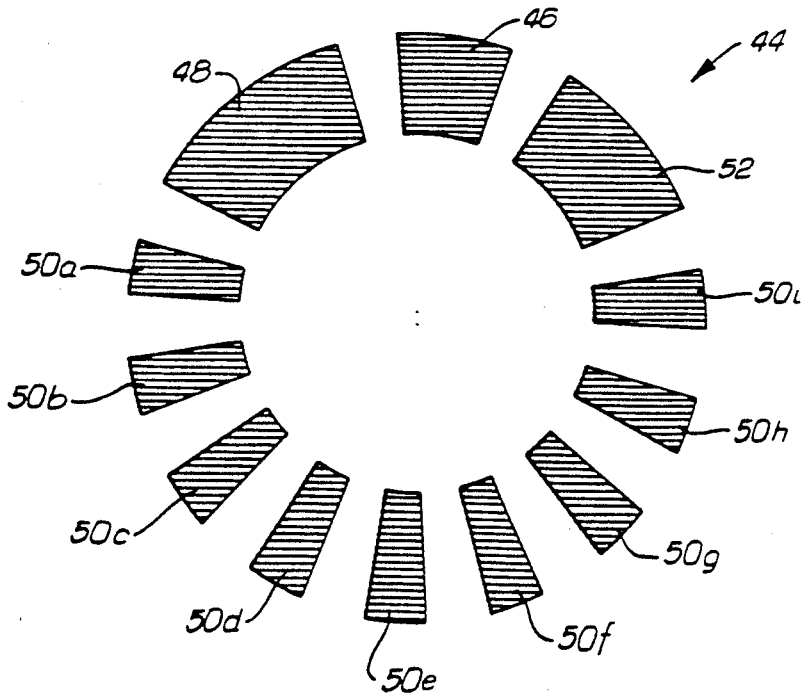
FIG. 2 is a view of a bar code present on a ribbon assembly.

FIG. 2 is a detailed illustration of a bar code 44 suitable for use in the present invention. The illustrated circular bar code 44 representing one embodiment of the present invention may have encoded therein up to about ten different numbers. The number(s) encoded on the bar code 44 are generally interpreted by scanning or reading means (e.g., reference character 58 of FIG. 6) as being either reflective or non-reflective. Typically, the number(s) encoded on the bar code 44 will be associated with a particular pre-determined set of printer operating parameters. The scanning or reading means (e.g., 58 of FIG. 6) would read the number, the number would then be compared to stored numbers, each of which is associated with particular printer operating parameters. When the encoded number is matched with a "stored number", the operating parameters associated with said "stored number" are implemented by the printer.

In one preferred embodiment of the present invention, illustrated in FIG. 2, the bar code 44 represents 1 of 10 numbers. The bar code 44 is adapted to be affixed, to one of the flanges 18 or 34. The bar code 44 itself comprises a start bar 46, a fat bar 48, nine clock bars **50*a–i* and a stop bar 52. The term "bar" refers to a non-reflecting (dark) portion of the bar code 44. In the illustrated embodiment, the bar code 44 is divided into 30 spaces with each space representing 12 degrees of rotation. Each clock bar 50*a–i* and each reflecting (white) area represent 1 space. The start bar 46 is twice as wide as a clock bar 50*a–i*, the stop bar 52 is 3 times as wide as a clock bar 50***a–i* and the fat bar 48 is 4 times as wide as a clock bar 50*a–i*.

The start bar 46 indicates the beginning of the reading cycle and the stop bar 52 indicates the end of the reading cycle. The encoded number itself is equal to the number, of clock bars 50*a–i* the start bar 46 and the fat bar 48. The reading cycle always runs; start bar 46 n clock bars 50*a–i* (n=0 to 9), fat bar 48, m clock bars 50*a–i* ($m=9-n$), stop bar 52. The encoded number is equal to n. Therefore, in the illustrated embodiment, the encoded number is 0.

Figure 3:
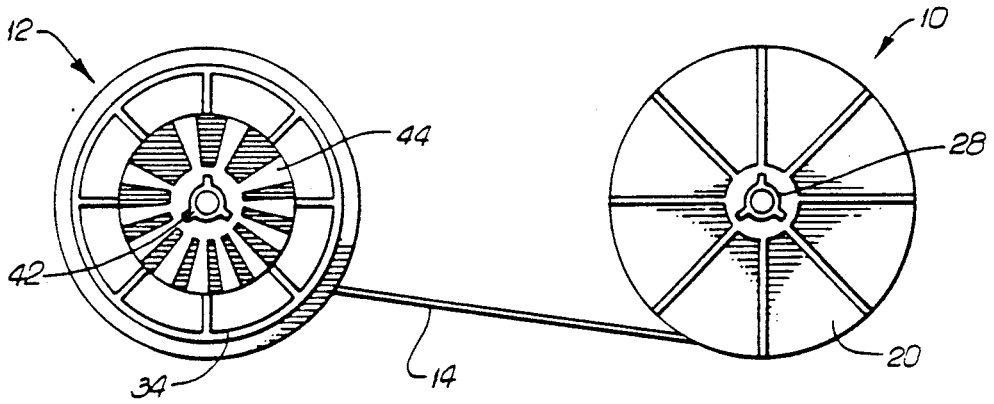
FIG. 3 is a bottom view of the ribbon assembly of FIG. 1 as viewed along line 3—3 of FIG. 1.

FIG. 3 depicts a bottom view of the ribbon assembly. In the embodiment of the present invention illustrated in FIG. 3, the bar code 44 is shown as being carried by ribbon take-up spool 12, specifically by the second take-up flange 34.

Means suitable for scanning or reading the bar code 44 are known to those skilled in the art. Typically, such scanners or readers function by generating some form of electromagnetic radiation. This eletromagnetic radiation is directed onto the bar code. Since the bar code comprises reflecting and non-reflecting areas, some of the electromagnetic radiation directed onto the bar code is reflected and some is not. The reflected electromagnetic radiation is sensed by a sensing means such as an optical sensor present within the scanning or reading means. This pattern of reflected and non-reflected electromagnetic radiation is interpreted by the scanning/-reading means as a specific number.

In practice, the bar code is read by scanning or reading means and the information encoded in the bar code is used to automatically set various operating parameters of a printing mechanism.

For example, an optical sensor (e.g., reference character 58 of FIG. 6) is employed to read the bar code 44. As discussed above, in one preferred embodiment, the bar code 44 represents one of ten numbers (0–9). A microcomputer (e.g., reference character 68 of FIG. 6) is employed to receive data from the optical sensor 58 and decoded it as a number from 0–9. The microcomputer 68 then compares the number read from the bar code 44 with a stored range of numbers to ensure that the number is within a preset range of acceptable values, i.e., 0–9. If the number read and decoded is not within the proper range, it is assumed an error has been made in the reading of the bar code 44 and a new reading is taken and the process begins again. If the number read and decoded is within the correct range, a pointer is set up to a stored table which matches certain preset operating parameters with each of the numbers 0–9. The microcomputer 68 then indexes into the table via the pointer and the operating characteristics associated with the indicated number are instituted by the microcomputer 68.

Figure 4:
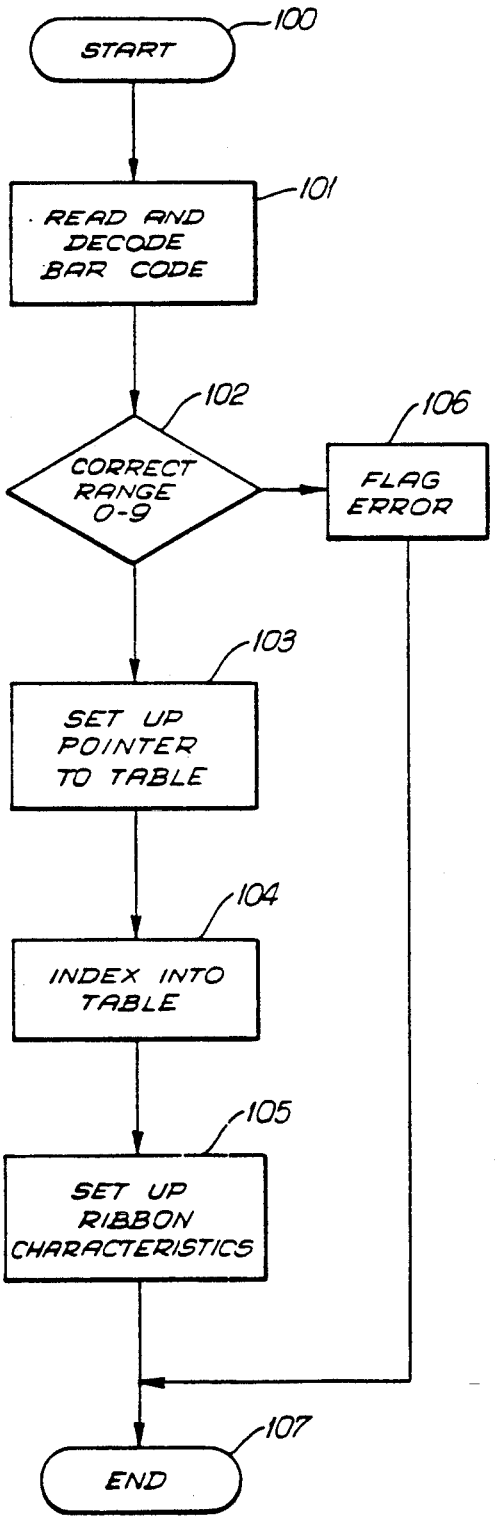
FIG. 4 is a flow diagram illustrating a first use of an embodiment of the present invention.

Those skilled in the art will recognize that a number of microcomputers are suitable for use in the present invention. One example of a suitable microcomputer is a microcomputer sold by Intel under the trade number 8031. The above described process of comparing a number encoded on the bar code 44 to a stored number associated with specific operating parameters is illustrated in the flow diagram of FIG. 4 (see steps 100–107)

For example, based on input provided from data encoded on the bar code 44, a thermal printer may be automatically set to employ a single pass ribbon. Alternatively, a different ribbon assembly may be employed in the same thermal printer which ribbon assembly comprises a bar code 44 which indicates that the printing ribbon is a multipass ribbon. Through the present invention adjustments necessary to employ the second ribbon assembly can be automatically instituted.

Another example of the present invention would be the use of bar code 44 to signal an operator as to the near depletion of the printing ribbon 14 contained on the ribbon supply spool 10. This is accomplished in the following manner. The bar code 44 is adapted to be read and decoded by scanning or reading means (e.g., reference character 58 of FIG. 6). The scanning or reading means (e.g., reference character 58 of FIG. 6) is capable of determining the speed of rotation of the bar code 44. If, as illustrated in FIG. 3, the bar code 44 appears on the take-up spool 12, as the supply of ribbon 14 contained on the ribbon supply spool 10 is depleted, the speed of rotation of the ribbon take-up spool 12 is decreased. Based on the speed of rotation of the bar code 44 affixed to the ribbon take-up spool 12, it is possible to determined the relative amount of ribbon 14 remaining on the ribbon supply spool 10. In other words, as the amount of ribbon 14 remaining on the ribbon supply spool 10 decreases, the speed of rotation of the bar code 44 affixed to the ribbon take-up spool 12 decreases. Upon reaching a pre-determined speed of rotation, the means 58 for scanning or reading the bar code 44 generates a signal to an operator indicating a low amount of ribbon 14 remaining on the ribbon supply spool 10.

Figure 5:
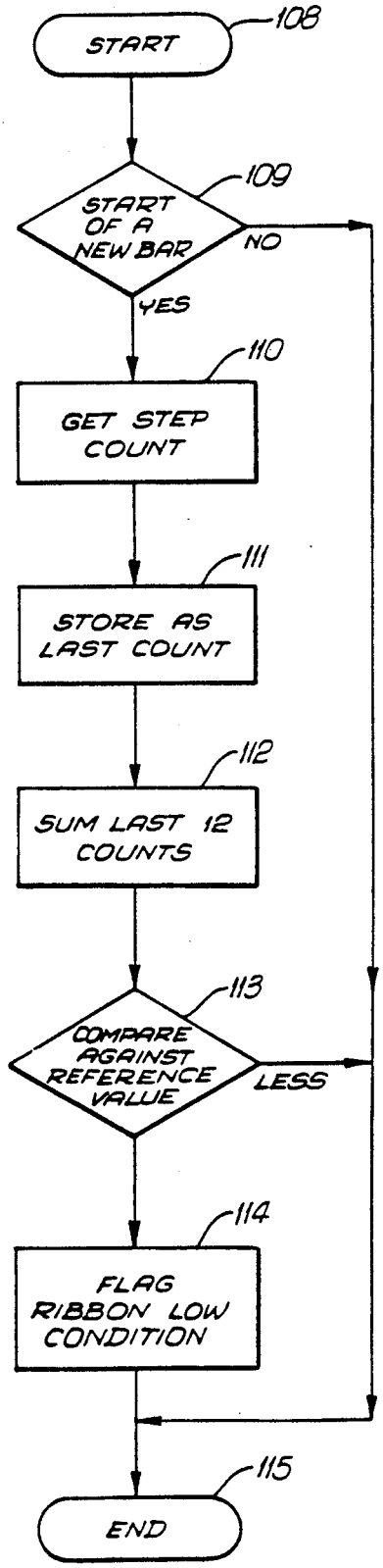
FIG. 5 is a flow diagram illustrating a second use of an embodiment of the present invention.

Specifically, the ribbon take-up spool 12 is driven by a stepper motor (e.g., reference character 43 in FIG. 1) through a slip drive system (e.g., reference character 45 in FIG. 1. A "stepper motor" is a motor which operates on pulses of power with each pulse causing the, motor to rotate a fixed amount. The stepper motor 43 is driven by a microcomputer 68 at a constant rate. However, as the take-up spool 12 fills up with ribbon 14, it rotates at a decreasing rate of speed. As described above, the scanning or reading means 58 is capable of reading reflecting and non-reflecting areas on the bar code 44. The scanning or reading means 58 and the microcomputer 68 are therefore capable of determining when the bar code 44 has rotated one complete revolution, that is, when the scanning or reading means 58 and microcomputer 68 have, in the illustrated embodiment, registered 12 non-reflecting bars. The scanning or reading means 58 and microcomputer 68 counts the number of stepper motor pulses occuring from the start of one bar to the start of the next (both reflecting and non-reflecting). In the illustrated embodiment, the bar code 44 comprises 12 bars. Accordingly, there will be 12 series (from the start of one bar to the start of the next) of stepper motor pulses in a complete rotation of the bar code 44. The microcomputer 68 stores the last 12 series of stepper motor pulses. The sum of the 12 stored values equals the number of stepper motor pulses required to produce one complete rotation of the take-up spool 12. The microcomputer 68 is programmed with a reference value. This reference value is the number of stepper motor pulses per revolution of the take-up spool 12 at which the supply of ribbon 14 on the ribbon supply spool 10 is considered low. When the number of stepper motor pulses required to produce one revolution of the take-up spool 12 equals or is greater than the stored reference value, the microcomputer 68 generates a signal which indicates a low ribbon condition. FIG. 5 illustrates a flow diagram which represents the above described process steps employed in determining whether or not a low ribbon condition should be indicated based on the number of stepper motor pulses required to produce a full revolution of the ribbon take-up spool 12 (see steps 108–115).

According to practice of an embodiment of the present invention, there is provided a ribbon assembly 56 as hereinbefore described. There is also provided printing means 60 and means 58 for reading the bar code 44 appearing on the ribbon assembly 56. After initial attachment of the ribbon assembly 56 to the printing means 60, reading means 58 reads the data encoded in the bar code 44 affixed to the ribbon assembly 56. Based on the data encoded in the bar code 44, various operating parameters of the printing means 60 are automatically set. If, at a later date, a ribbon assembly requiring different printing parameters is attached to the printing means 60, the reading means 58 reads the bar code 44 affixed to said ribbon assembly and automatically adjusts the printing parameters of the printing means 60 to print with such new ribbon assembly.

FIG. 6 illustrates a printing assembly 54 in accordance with an embodiment of the present invention. The printing assembly 54 comprises a ribbon assembly 56, a reading means 58, and a printing means 60. The printing means 60 may comprise, for example, a thermal printhead 67 and a microcomputer 68. The ribbon assembly 56 is shown mounted in the printing assembly 54 in a generally horizontal position. That is, the ribbon assembly 56 is positioned within the printing assembly 54 so that the longitudinal plane of the printing ribbon 14 is generally horizontal. The readings means 58 is located to be able to read a bar code 44 located on the ribbon assembly 56 as hereinbefore described. Guide means 59 serve to position the printing ribbon 57 in an operable relation with the printing means 60. Finally, the printing means 60 is located on one side of a printing area 62 and a printing surface 64 is located on the opposite side of the printing area 62. The printing means 60 is located in an operative relationship with printing area 62 and printing surface 64. Data read by reading means 58 from the bar code 44 on ribbon assembly 56 is supplied to printing means 60 along data transmission means 66.

The above description of the presently preferred embodiment of the present invention is intended to illustrate, by way of example, the novel features that are believed to be characteristic of the present invention. It is to be expressly understood, however, that the specific embodiment is for the purpose of illustration and description only, and is not intended as a definition of the limits of the invention. Other embodiments of the present invention are therefore included within the scope of this invention.

What is claimed is:

1. A method of indicating a low ribbon condition of a printer operable according to printer operating parameters and having a ribbon supply spool, a ribbon take-up spool and a machine readable coded indicia having X indicia elements, the X indicia elements including Y indicia elements, the X indicia elements being carried by at least one of the ribbon supply spool and the ribbon take-up spool, wherein Y is a number at least as great as 0, the method comprising the steps of:

providing means for reading the coded indicia and determining the number Y;

determining the operating parameters dependent on the number Y;

rotating the ribbon supply spool and ribbon take-up spool;

determining the speed of rotation of at least one of the ribbon supply spool and the ribbon take-up spool by reading the X indicia elements; and indicating a low ribbon condition based on the speed of rotation of at least one of the ribbon supply spool and the ribbon take-up spool.

2. A ribbon assembly for a printer operable according to a printer parameter, the ribbon assembly comprising:

an indicia detector;

a rotatable ribbon spool;

an array of x indicia elements movable adjacent the indicia detector upon rotation of the ribbon spool, the array of x indicia elements including y first element(s);

drive means for incrementally driving the ribbon spool and the array, and for moving the x indicia elements adjacent the detector for each full rotation of the ribbon spool;

first counting means for counting the number of drive increments driven by the drive means upon movement of x indicia elements adjacent the indicia detector;

comparison means for comparing the number of drive increments counted by the first counting means with a predetermined value;

signaling means for signaling a low ribbon condition upon the number of increments counted by the first counting means being at least as great as the predetermined value;

second counting means for counting the number of first element(s) moved adjacent the indicia detector by the drive means; and identifying means for identifying the printer parameter in dependence on the number counted by the second counting means;

wherein x is a number greater than 1 and y is a number at least as great as 0.

3. A ribbon assembly as claimed in claim 2, wherein the array of x indicia elements comprises a rotatable annular bar code having x bars.

4. A ribbon assembly as claimed in claim 2, wherein the array of x indicia elements further comprises u start indicia element(s), v stop indicia element(s), w second element(s), and z separating element(s) arranged between the y first element(s) and the w second element(s);

wherein $x=u+v+w+y+z$, and $0 \leqq y \leqq x-(i+v+z)$.

5. A ribbon assembly as claimed in claim 4, wherein $u=1$, $v=1$, $z=1$, and $x=12$.

6. In a printing apparatus operable with up to t types of ribbon spools, an improved ribbon spool comprising:

a rotatable spool core;

coded indicia rotatable with the spool core, the coded indicia having x indicia elements, the x indicia elements including y first indicia elements(s), u start element(s), v stop element(s), w second indicia element(s), and z separating element(s);

wherein, $x=u+v+w+y+z$;

wherein $0 \leqq y \leqq x-(u+v+z)$; and wherein, $t=[x-(u+v+z)]+1$.

7. A ribbon spool as claimed in claim 6, wherein:

$u-1$;

$v=1$;

$z=1$; and $x=12$.

8. A ribbon spool as claimed in claim 6, wherein the printing apparatus is operable according to an operating parameter and wherein the number y represents the operating parameter.

* * * * *